US010325459B2

(12) United States Patent
Bagozzi et al.

(10) Patent No.: US 10,325,459 B2
(45) **Date of Patent: *Jun. 18, 2019**

(54) SYSTEM AND METHOD FOR SNAP-ON EMERGENCY EXIT LED LIGHTING

(71) Applicants: Nicole Bagozzi, Mesa, AZ (US); Scott Evans, San Tan Valley, AZ (US)

(72) Inventors: Nicole Bagozzi, Mesa, AZ (US); Scott Evans, San Tan Valley, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/946,051

(22) Filed: Apr. 5, 2018

(65) Prior Publication Data

US 2018/0293855 A1 Oct. 11, 2018

Related U.S. Application Data

(63) Continuation-in-part of application No. 15/480,930, filed on Apr. 6, 2017.

(51) Int. Cl.

| | |
|---|---|
| ***G08B 7/06*** | (2006.01) |
| ***F21V 23/00*** | (2015.01) |
| ***F21S 9/02*** | (2006.01) |
| ***F21V 5/04*** | (2006.01) |
| ***F21V 23/04*** | (2006.01) |
| ***F21S 8/00*** | (2006.01) |
| ***F21S 8/04*** | (2006.01) |
| ***F21V 21/04*** | (2006.01) |
| ***F21S 4/24*** | (2016.01) |

(Continued)

(52) U.S. Cl.

CPC ..... *G08B 7/062* (2013.01); *F21S 4/24* (2016.01); *F21S 8/033* (2013.01); *F21S 8/043* (2013.01); *F21S 9/022* (2013.01); *F21V 5/04* (2013.01); *F21V 21/041* (2013.01); *F21V 21/048* (2013.01); *F21V 23/003* (2013.01); *F21V 23/0435* (2013.01); *F21W 2111/00* (2013.01); *F21Y 2103/10* (2016.08); *F21Y 2113/13* (2016.08); *F21Y 2115/10* (2016.08)

(58) Field of Classification Search

CPC . G08B 7/062; G08B 7/06; G08B 5/22; G08B 5/36; G08B 5/223; G08B 29/126; F21S 8/033; F21S 8/04; F21S 9/02; F21F 8/043; F21F 9/022; F21V 3/02; F21V 23/0435; G09F 13/00

USPC ... 340/815.45, 815.4, 815.48, 815.5, 539.11, 340/539.23; 362/147, 153, 234, 241, 368, 362/388

See application file for complete search history.

(56) References Cited

U.S. PATENT DOCUMENTS

| | | | |
|---|---|---|---|
| D279,714 | S | 7/1985 | Taylor |
| 5,009,383 | A | 4/1991 | Chapman |

(Continued)

FOREIGN PATENT DOCUMENTS

| | | |
|---|---|---|
| WO | 2011/036606 | 3/2011 |
| WO | 2011/112261 | 9/2011 |

(Continued)

*Primary Examiner* — Hung T Nguyen

(74) *Attorney, Agent, or Firm* — Evan Schechter

(57) ABSTRACT

A system and method for snap-on emergency exit LED lighting. The emergency exit lighting fixture comprises a structure for housing at least one LED light, an LED driver electronically coupled to the LED light(s), a continuous power source, a backup power source, and a test switch. The fixture, in various configurations, may be mounted to an existing T-grid. The fixture may be tested remotely.

6 Claims, 13 Drawing Sheets

(51) Int. Cl.

| | |
|---|---|
| *F21W 111/00* | (2006.01) |
| *F21Y 115/10* | (2016.01) |
| *F21Y 113/13* | (2016.01) |
| *F21Y 103/10* | (2016.01) |

(56) References Cited

U.S. PATENT DOCUMENTS

| | | | | |
|---|---|---|---|---|
| 5,130,909 | A | 7/1992 | Gross | |
| D496,122 | S | 9/2004 | Kan | |
| 7,652,590 | B2 | 1/2010 | Lin | |
| D615,223 | S | 5/2010 | Huang | |
| D736,432 | S | 8/2015 | Elwell et al. | |
| 9,182,091 | B2 | 11/2015 | Gershaw | |
| 9,316,363 | B2 | 4/2016 | Lee et al. | |
| 9,441,818 | B2 | 9/2016 | Dixon et al. | |
| 2004/0252488 | A1 | 12/2004 | Thurk | |
| 2005/0286247 | A1 | 12/2005 | Peterson | |
| 2006/0139161 | A1* | 6/2006 | Beghelli | G08B 7/062 340/514 |
| 2007/0120699 | A1 | 5/2007 | Pennington | |
| 2007/0189001 | A1 | 8/2007 | Nielson et al. | |
| 2014/0292198 | A1 | 10/2014 | Sanders et al. | |
| 2016/0116125 | A1 | 4/2016 | Lydecker et al. | |
| 2016/0138789 | A1 | 5/2016 | Brown | |
| 2016/0141914 | A1* | 5/2016 | McBryde | H02J 9/02 315/161 |
| 2016/0286619 | A1* | 9/2016 | Roberts | H05B 33/0854 |
| 2016/0369981 | A1 | 12/2016 | Emde et al. | |
| 2017/0074474 | A1 | 3/2017 | Bailey | |
| 2017/0268744 | A1* | 9/2017 | Hsia | F21V 5/04 |
| 2017/0321852 | A1 | 11/2017 | Handsaker et al. | |

FOREIGN PATENT DOCUMENTS

| | | |
|---|---|---|
| WO | 2012/028819 | 3/2012 |
| WO | 2013/149679 | 10/2013 |
| WO | 2015/161217 | 10/2015 |
| WO | 2016133493 | 8/2016 |
| WO | 2017/142907 | 8/2017 |

* cited by examiner

SYSTEM AND METHOD FOR SNAP-ON EMERGENCY EXIT LED LIGHTING

PRIORITY

The present invention claims priority to U.S. patent application Ser. No. 15/480,930, entitled "System and Method for Emergency Exit Lighting Inventors", filed on Apr. 6, 2017, herein incorporated by reference.

BACKGROUND OF THE INVENTION

Field of the Invention

The present invention relates to devices used for emergency exit lighting, and more particularly to a system and method for replaceable emergency exit lighting.

Description of Related Art

The field of emergency exit lighting has remained relatively stagnant for the past few decades. The design of valid emergency exit lighting is governed by local rules and international norms such as the International Building Code and the International Fire Code. Typical emergency exit lighting is comprised of large lights strategically placed in as few areas as possible.

Most, if not all, currently available emergency lighting is comprised of fluorescent or incandescent lighting sources. LED emergency lights may be an improvement in terms of power consumption, longevity, cost, design, and ease of use. The current invention may also be an improvement in terms of ease of manufacture and installation.

Prior art has described a variety of emergency lighting systems and methods, and a variety of LED lighting systems and methods. However, none provide a reliable LED emergency lighting system and method.

Prior art has described a T-bar for a suspended ceiling with heat sinks for LED lights. This apparatus is inadequate and over-complicated for emergency LED lights. Since emergency LED lights run for limited amounts of time, heat sinks may be unnecessary. In addition, this apparatus is inadequate for emergency lighting testing and battery purposes.

Prior art has described a light-emitting ceiling tile apparatus. This apparatus is inadequate for emergency lighting purposes as it does not include an ability to test the apparatus or provide for a backup battery.

Prior art has described suspended LED lighting systems. This apparatus is inadequate for emergency lighting purposes as it does not include an ability to test the apparatus or provide for a backup battery.

Prior art has described emergency LED lighting systems that rest on T-bars in the place of ceiling tiles. These systems are inadequate because they consume too much space and are not aesthetically pleasing. These systems function differently than the present invention.

Prior art has described emergency lighting systems located in the floor or adjacent to the floor. These systems are inadequate because they may not provide enough illumination to satisfy emergency exit lighting codes and may easily break compared to ceiling, doorway, and wall emergency exit lights.

Prior art has described various emergency exit lighting strips. These systems are inadequate because they cannot replace a standard T-bar or doorway and cannot be integrated within a wall.

BRIEF SUMMARY OF THE INVENTION

The present invention provides among other things a system for emergency exit lighting using LED lighting fixtures and a method for testing emergency exit lighting fixtures. It is an objective of the invention to provide emergency lighting fixtures that are safer, more economical, easy to use and easy to install, easy to test, and that provide better and more useful emergency lighting than existing emergency lighting systems.

The above and other objectives may be achieved using systems involving an elongate semi-rigid flat base extending between a first end and a second end, said flat base comprising a right edge, a left edge, a top plane, and a bottom plane. At least one right top catch may extend along a portion of said right edge. At least one left top catch may extend along a portion of said left edge. At least one right bottom catch may extend along a portion of said right edge. At least one left bottom catch may extend along a portion of said left edge. At least one LED light may be mounted on said bottom plane. The LED light(s) should be electronically coupled to an LED driver, which should also be electronically coupled to a first, continuous power source, a backup battery power source, and an on/off test button switch. A translucent lens panel may be mounted at least partially below said bottom plane via said at least one right bottom catch and said at least one left bottom catch and adapted to diffuse light from said LED light. The fixture may be mounted to a T-grid by attaching said at least one left top catch and said at least one right top catch to the T-grid.

Some aspects of the invention may include a translucent lens that comprises at least one cut-out, with a red or green color translucent lens panel placed within the at least one cut-out.

Some aspects of the invention may include white, red, and/or green LED(s).

Some aspects of the invention may include a wireless antenna electronically coupled to the on/off test switch and the LED driver.

Some aspects of the invention may include a wireless antenna that is adapted to receive a signal from a Wi-Fi connected smartphone application so as to activate the on/off test switch.

Some aspects of the invention may further comprise a T-grid coupled with at least one left top catch and at least one right top catch.

The above and other objectives may be achieved by using a method of installing a snap-on emergency exit lighting fixture comprising the steps of: drilling at least one wire-path aperture through a T-grid; attaching said lighting fixture via at least one catch to said T-grid; guiding a lighting fixture conduit through at least one wire-path aperture; and electronically coupling said lighting fixture to a power supply.

The above and other objectives may be achieved by using a method further comprised of first removing the T-grid from a ceiling, prior to the step of drilling.

The above and other objectives may be achieved by using a method further comprising the step of replacing the T-grid with the attached lighting fixture in the ceiling after the step of guiding.

The above and other objectives may be achieved by using a method further comprising the step of electronically coupling the lighting fixture to an LED driver.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. It should be noted that there are many different and alternative configurations, devices and technologies to which the disclosed inventions may be applied. The full scope of the inventions is not limited to the examples that are described below.

Figure 1:
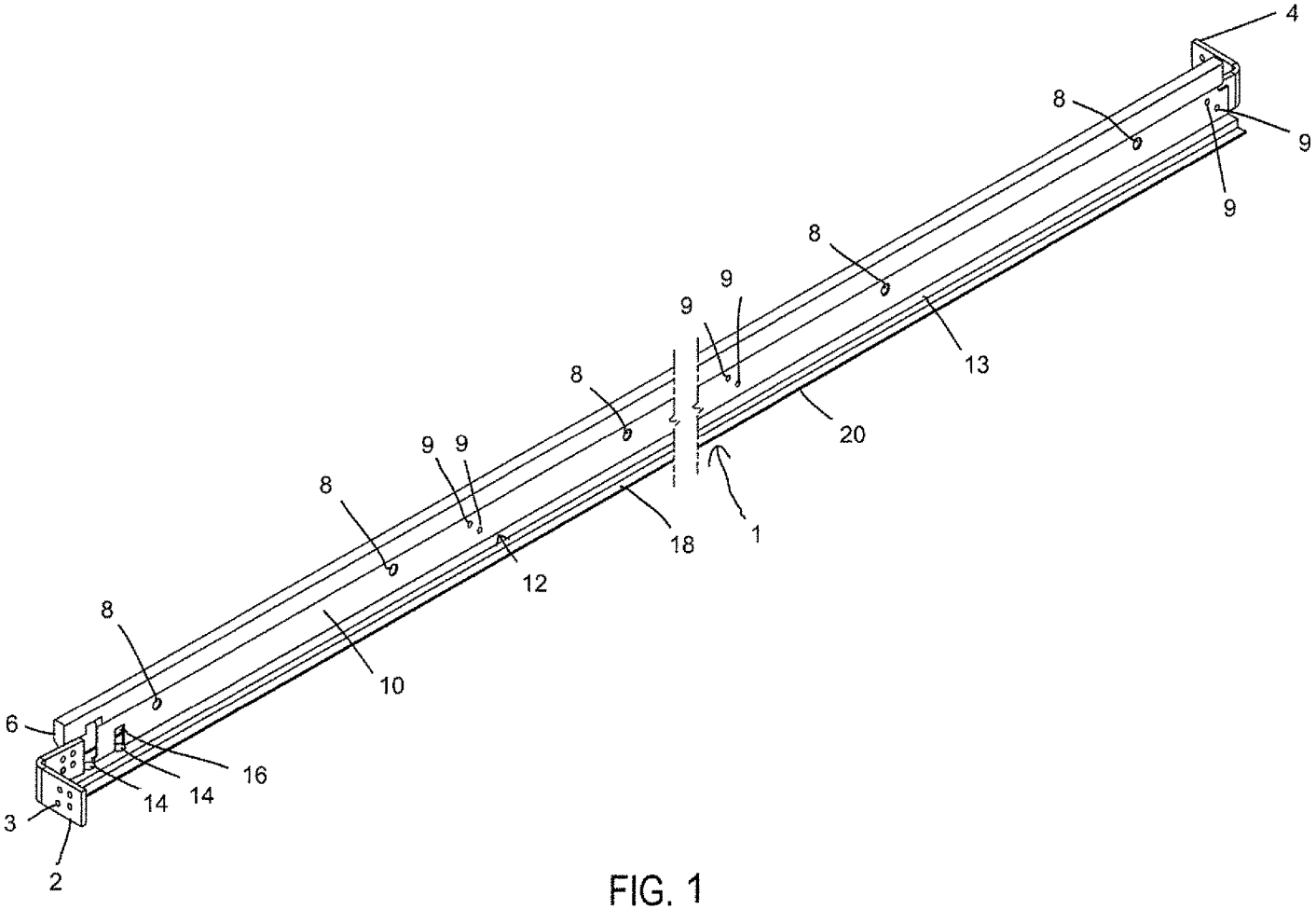
FIG. 1 depicts an isometric top view of a possible embodiment of the present invention that may be used in a ceiling.

An embodiment of the invention is shown in FIG. 1. An emergency exit lighting fixture 1 may comprise the following: a first end bracket 2, a second end bracket 4, an elongate thin rigid spine 10, an elongate substantially rigid flat base 12, with a top plane 13 and a bottom plane. An LED light may be coupled to the bottom plane.

The emergency exit lighting fixture 1 may further comprise a substantially thicker portion support rim 6 for stability, structural support, and ease of manufacture. The support rim 6 may be solid, hollow, or a combination thereof. The support rim 6 may be coupled to the rigid spine 10 and comprise up to half of the width of the emergency exit lighting fixture 1. The rigid spine 10 may further comprise a plurality of holes 8 and 9 so that the fixture can pair with complementary hanging device(s) so that it may be suspended from a ceiling, such as with one or more wires or supports holding the fixture through the holes 8 and/or 9. The rigid spine 10 may also comprise one or more substantially rectangular cutouts 16 through which a power source, such as a wire or a conduit with one or more wires inside, may be threaded through one or more holes 14 in the flat base 12 to power at least one LED light (not shown) coupled to the bottom plane. Additional holes 8 and/or 9 may be added to save weight and/or dissipate heat.

The embodiment shown in FIG. 1 may replace a T-Grid (also known as a T-bar), as is known in the art for standard structure in drop ceilings. Flanges on standard T-Grids may support acoustic tiles, air conditioning vents, and the like. The emergency exit lighting fixture may also support acoustic tiles. T-Grids, and this embodiment of the present invention, typically come in two-foot or four-foot segments. The first end bracket 2 and the second end bracket 4 may be adapted to attach to regular T-Grids. The thicker portion 6 of the elongate rigid spine 10 may have a substantially rectangular or circular axial cross-section.

The flat base 12 may further comprise one or more edge flanges, including a first edge flange 18, which may support acoustic tiles and/or a translucent lens panel 20 mounted to the flat base 12. The translucent lens panel 20 may be substantially the same size and shape as the flat base 12, or it may be smaller.

The rigid spine 10 and flat base 12 may be formed from a variety of materials, such as metals, plastics, and/or wood. The rigid spine 10 and flat base 12 may be formed together as one extrusion, or they may be formed as separate pieces and coupled together through fasteners, glue, welding, and/or any other way. The rigid spine 10 may be located substantially equidistant between the edges of the flat base 12. The flat base 12 is substantially perpendicular to the rigid spine 10 and is substantially the same length as the rigid spine 10. The flat base 12 may have a substantially rectangular shape with a top plane 13 and a bottom plane.

The first end bracket 2 and the second end bracket 4 may be adapted to couple with existing T-Grids or a different ceiling assembly, They may couple through the use of fasteners, glue, welding, and/or magnets. A plurality of holes 3 may be used to couple the first end bracket 2 and second end bracket 4 to existing ceiling assemblies, such as T-Grids. It is intended that the emergency exit lighting fixture be relatively easy to manufacture and install.

One or more antennae may be mounted to the emergency exit lighting fixture 1 in order to receive wireless, Wi-Fi. RFID, and/or Bluetooth signals.

Figure 2:
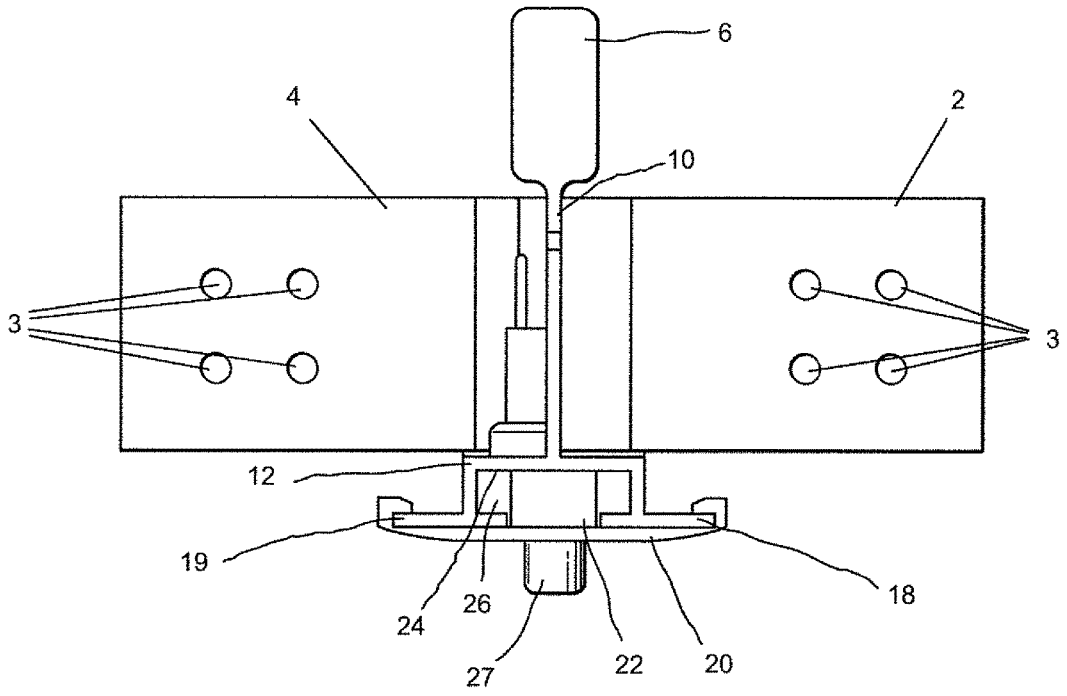
FIG. 2 depicts a front view of a possible embodiment of the present invention that may be used in a ceiling.

Referring now to FIG. 2, a frontal view of the possible embodiment in FIG. 1 of the present invention is shown with a first end bracket 2, second end bracket 4, elongate thin rigid spine 10 with a support rim 6, elongate substantially rigid flat base 12 with a top plane and a bottom plane 24, first edge flange 18, second edge flange 19, translucent lens panel 20, at least one LED light 22 coupled to the bottom plane 24 and located within a recessed channel 26, and an on/off test button switch 27 along the length of the emergency exit lighting fixture.

The first end bracket 2 and the second end bracket 4 may be adapted to couple with exiting T-Grids or a different ceiling assembly. They may couple through the use of fasteners, glue, welding, and/or magnets. It is intended that the emergency exit lighting fixture be relatively easy to manufacture and install. A plurality of holes 3 may be used to couple the first end bracket 2 and second end bracket 4 to existing ceiling assemblies, such as T-Grids.

The edge flanges 18 may be used to support and hold acoustic ceiling tiles and/or a translucent lens panel 20. The translucent lens panel 20 may be clear, frosty, red, and/or green. The translucent lens panel 20 may also have at least one area cut out in the shape of the word EXIT. A red or green translucent lens panel may be placed within the cut out portion. The translucent lens panel 20 may also have at least one area cut out in the shape of an arrow, to indicate emergency exit direction. A red or green translucent lens panel may be placed within the cut out portion. The translucent lens panel 20 may be easily removable in order to repair and maintain the fixture, and to allow the at least one LED light 22 to be replaced if necessary. The translucent lens panel 20 may be glass and/or plastic.

At least one LED light 22 may be mounted to the bottom plane 24 of the flat base 12 through glue, fasteners, welding, or any other means. The LED light(s) 22 may be red, green, yellow or white in color (i.e. they may produce light with a red, green, yellow, or white tint). The LED light(s) 22 should produce enough light to satisfy applicable emergency lighting codes and regulations. In its Life Safety Code, section 7.9, the National Fire Protection Agency (NFPA) states that emergency lighting must be arranged to provide initial illumination of not less than an average of one foot-candle and a minimum at any point of 0.1-foot-candle measured along the path of egress at floor level. These levels can decline to a minimum of 0.6-foot-candle average and 0.06-foot-candle at any one point at the end of 1.5-hours. One foot-candle is equivalent to 10.764 lumens per square meter or one lumen per square foot.

The LED light(s) 22 may be mounted to the bottom plane 24 of the flat base 12 and within a recessed channel 26. The recessed channel 26 may be useful in directing the light produced by the LED light(s) 22 downward and preventing light diffusion to the sides or upward. The recessed channel 26 may also ease manufacture and installation of the emergency exit lighting fixture.

An on/off test button switch 27 may be located along the translucent lens panel 20 so that the switch is easily accessible and easily activated to test the emergency exit lighting. Section 7.9.3 of the NFPA's Life Safety Code typically requires a monthly activation test, where the lights remain illuminated for a minimum of 30-seconds, and an annual test where the lights are activated for 1.5-hours to simulate a long-term emergency event. An alternative embodiment may have the on/off test button switch activated remotely through any of, or a combination of, wired control, wireless, Wi-Fi, RFID (radio frequency identification signal), cellular, and/or Bluetooth commands. A cellular application to activate an on/off test button switch 27 may be used. Such an application may save time and allow an interested party, such as a fire marshal, the ability to remotely test multiple emergency exit lighting fixtures at one time, and easily record the results of any such testing.

The LED light(s) 22 should be electronically coupled (i.e. wired) to an LED driver. The LED light(s) 22 may be electronically coupled through a conduit or whip that snakes through one or more holes 14 in the flat base 12. An LED driver should be electronically coupled to a first, continuous power source, a backup battery containing enough power to power the LED light(s) for at least 1.5-hours, and the on/off test button switch 27. The LED driver will control the functions of the LED light(s) 22 and may be modified as necessary. The LED driver may be located at some distance from the LED light(s), for example, in a typical junction box, and may be electronically coupled to the LED light(s) through a conduit or whip. The LED driver may also be electronically coupled to one or more antennae in order to receive wireless, Wi-Fi. RFID, and/or Bluetooth signals.

Figure 3:
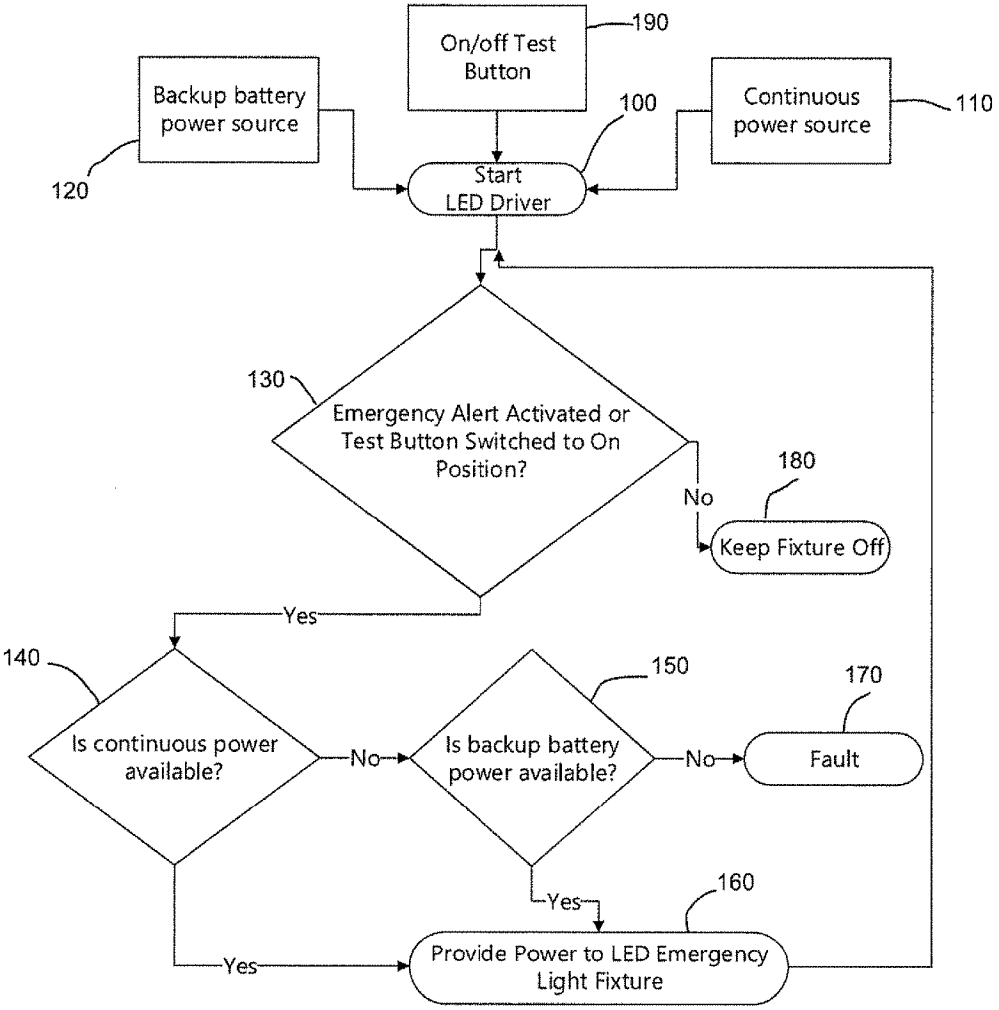
FIG. 3 depicts an example flowchart detailing a typical LED driver that may be used in an embodiment of the present invention.

Referring now to FIG. 3, an example flowchart describing a possible LED driver 100 is shown. A first, or continuous, power source 110, a backup battery power source 120, and an on/off test button switch 190 may be electronically coupled to an LED driver 100 which will control one or more LED light(s) on an emergency light fixture. Other wires, such as to a centralized fire control panel and/or alarm panel, may also be electronically coupled to the LED driver 100.

The LED driver 100 may continuously run while it receives power from either the first, continuous power source 110, or when that power is unavailable, from a backup battery power source 120. If an emergency alert, such as a fire alarm or burglar alarm, is activated, or the on/off test button 190 is switched to the on position, 130, the LED driver will determine if continuous power is available 140. If no emergency alert is activated and the on/off test button 190 is not switched to the on position, the LED driver will keep the LED light(s) on the emergency light fixture unpowered and off. If continuous power is available 140, the LED driver will provide that power to the LED emergency light fixture 160. If continuous power is unavailable 140, the LED driver will next determine if backup battery power is available 150. If backup battery power is available 150, the LED driver will provide that power to the LED emergency light fixture 160. If an emergency alert, such as a fire alarm or burglar alarm, is activated, or the on/off test button 190 is switched to the on position, 130, and neither continuous power 140 nor backup batter power 150 is available, then the LED emergency light fixture will be broken and will not provide emergency egress lighting, as a fault 170.

Alternative LED driver embodiments may include various power sources, various emergency alerts, electronic coupling(s) to centralized location(s) and centralized computer system(s). An LED driver may also embody wired, wireless, Wi-Fi. RFID, Bluetooth, antennae, and/or other means of communicating with a computerized system in order to activate the emergency light fixture, record results of tests, perform diagnostics, or other desired features. The LED driver may also be electronically coupled to one or more antennae in order to receive wireless, Wi-Fi. RFID, and/or Bluetooth signals.

Figure 4:
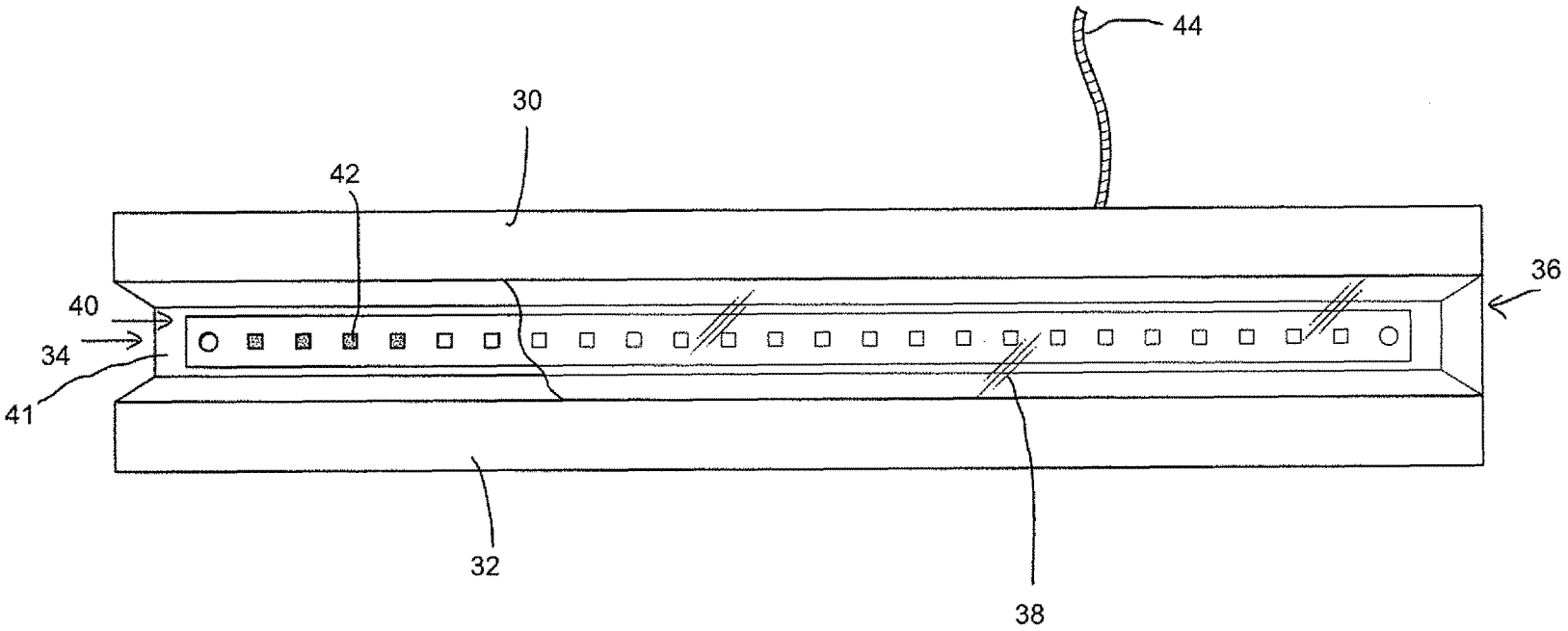
FIG. 4 depicts a frontal view of a possible embodiment of the present invention that may be used in a wall.

Referring now to FIG. 4, a front view of a possible embodiment of the invention is shown. A first flange 30 extends between a first end 34 and a second end 36. A second flange 32 also extends between the first end 34 and the second end 36. A recessed channel 40 lies between and connects the first flange 30 and the second flange 32. The recessed channel 40 may comprise an elongate substantially rigid flat base having a substantially rectangular shape, a top plane 41, and a bottom plane. At least one LED light 42 may be mounted on the top plane 41. A translucent lens panel 38 substantially the same dimensions, or slightly larger than, the top plane 41, may be mounted between the first flange 30 and the second flange 32. A conduit 44 is used to electronically couple the LED light(s) 42 to an LED driver.

The LED light(s) 42 should be electronically coupled (i.e. wired) to an LED driver. The LED light(s) may be white, red, green, or a combination thereof. The LED light(s) 42 may be electronically coupled through a conduit (also referred to as a whip) 44. An LED driver should be electronically coupled to a first, continuous power source, a backup battery containing enough power to power the LED light(s) for at least 1.5-hours, and an on/off test button switch. The LED driver will control the functions of the LED light(s) 42 and may be modified as necessary. The LED driver may be located at some distance from the LED light(s), for example, in a typical junction box. The LED driver and/or fixture may also be electronically coupled to one or more antennae in order to receive wireless, Wi-Fi. RFID, and/or Bluetooth signals.

The first flange 30, second flange 32, and recessed channel 40 may be formed from a variety of materials, including metals, plastics, and/or wood.

The translucent lens panel 38 may be clear, frosty, red, and/or green. The translucent lens panel 38 may also have at least one area cut out in the shape of the word EXIT. A red or green translucent lens panel may be placed within the cut out portion. The translucent lens panel 38 may also have at least one area cut out in the shape of an arrow, to indicate emergency exit direction. A red or green translucent lens panel may be placed within the cut out portion. The translucent lens panel 38 may be easily removable in order to repair and maintain the fixture, and to allow the at least one LED light 42 to be replaced if necessary. The translucent lens panel 38 may be glass and/or plastic.

Figure 5:
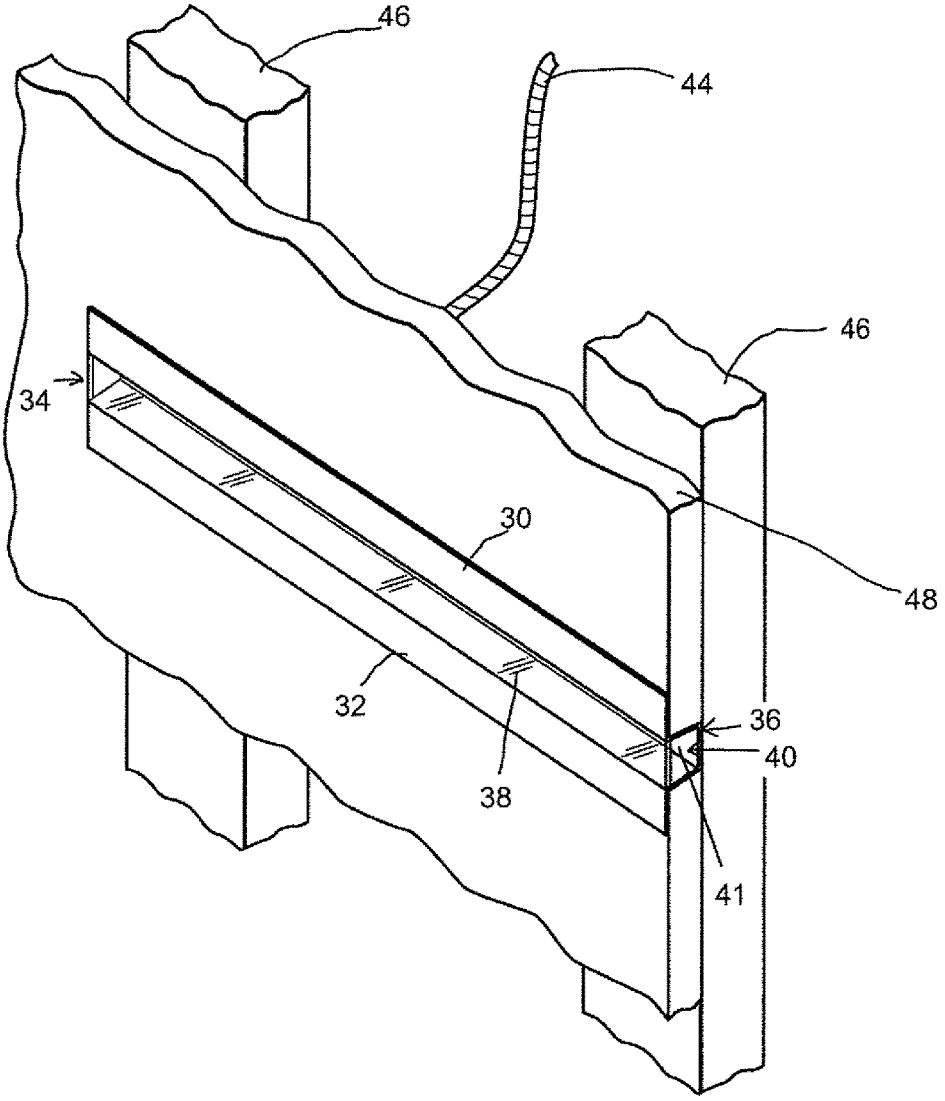
FIG. 5 depicts an isometric view of a possible embodiment of the present invention in an installed configuration on a cutaway wall.

Referring now to FIG. 5, an isometric view of the possible embodiment in FIG. 4 is shown installed in a wall. A first flange 30 extends between a first end 34 and a second end 36. A second flange 32 also extends between the first end 34 and the second end 36. A recessed channel 40 lies between and connects the first flange 30 and the second flange 32. The recessed channel 40 may comprise an elongate substantially rigid flat base having a substantially rectangular shape, a top plane 41, and a bottom plane. A translucent lens panel 38 substantially the same dimensions, or slightly larger than, the top plane 41, may be mounted between the first flange 30 and the second flange 32. A conduit 44 is used to electronically couple at least one LED light(s) to an LED driver.

The wall-mounted emergency LED light fixture may be mounted within drywall 48, or other types of wall material, and coupled to support beams 46. The recessed channel 40 should be no deeper than the thickness of the drywall 48, typically ⅝ of an inch. If the recessed channel 40 is ⅝ of an inch or less deep, the first flange 30 and the second flange 32 could be flush with the drywall 48. The first flange 30 and second flange 32 may be painted over, or finished to match the surrounding drywall 48.

The wall-mounted emergency LED light fixture may be mounted anywhere on a wall. It may be mounted vertically, horizontally, or at an angle. At a height of two feet above the floor, the wall-mounted LED light fixture may provide enough illumination to satisfy applicable codes, and may be aesthetically pleasing. This embodiment of the invention may also be installed in a ceiling which has similar characteristics to a wall.

Figure 6:
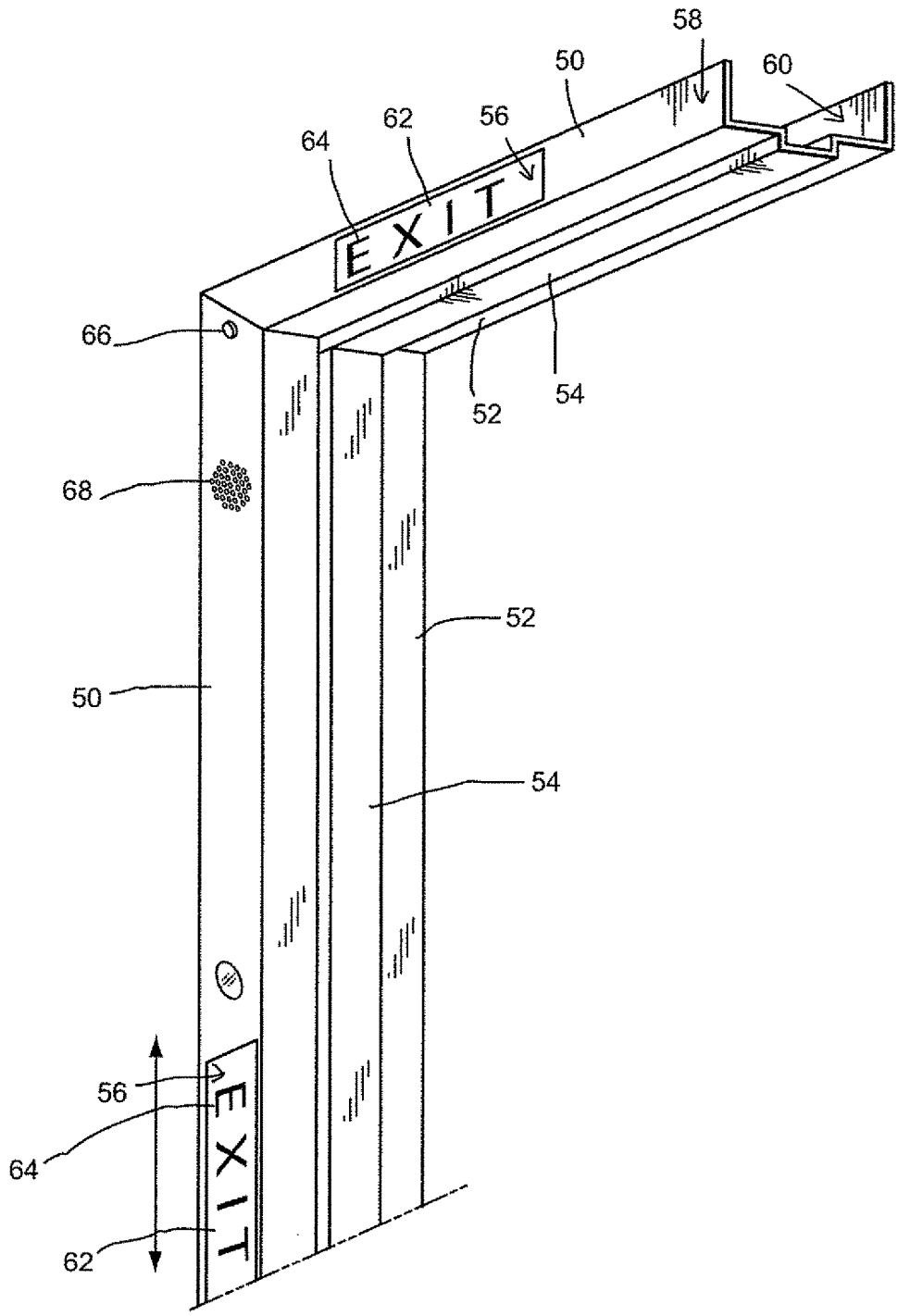
FIG. 6 depicts a partial isometric view of a possible embodiment of the present invention that may be used on a doorframe.

Referring now to FIG. 6, an isometric view of a portion of a possible embodiment of the invention is shown. A doorway emergency exit lighting fixture may comprise a casing 50 with a front 52 and a back 60, a jamb 52, and a stop 54. The casing 50, jamb 52, and stop 54 may extend to the right (side casing, side jamb, and side stop), left (side casing, side jamb, and side stop), and top (top casing, top jamb, and top stop) of a doorway. The casing 50 should have at least one substantially rectangular cut-out 56 that is smaller than the casing front 52. There may be one or more cut-out(s) 56 on each of the top casing or side casings. Cut-out(s) 56 on side casings may be located two feet or more from the floor. The casing 50, jamb 52, and stop 54 may be comprised of wood, plastics, metals, or a combination thereof.

A translucent lens panel 62 substantially the same dimensions, or slightly larger than, the cut-out 56, may be mounted over the cut-out 56. At least one LED light electronically coupled to an LED driver should be placed behind the translucent lens panel 62 to provide emergency exit and sign illumination. The LED light(s) may be white, red, green, or a combination thereof. The LED driver and/or fixture may also be electronically coupled to one or more antennae in order to receive wireless, Wi-Fi. RFID, and/or Bluetooth signals.

The translucent lens panel 62 may be clear, frosty, red, and/or green. The translucent lens panel 62 may also have at least one area cut out in the shape of the word EXIT 64. (EXIT may be replaced with the equivalent word in any other language.) A red or green translucent lens panel may be placed within EXIT cut-out 64. The translucent lens panel 62 may also have at least one area cut out in the shape of an arrow, to indicate emergency exit direction. A red or green translucent lens panel may be placed within the arrow cut-out portion. The translucent lens panel 62 may be easily removable in order to repair and maintain the fixture, and to allow the at least one LED light to be replaced if necessary. The translucent lens panel 62 may be glass and/or plastic.

An on/off test button switch 66 and an integrated speaker 68 may be located within the casing 50. The on/off test button switch 66 may be located on the casing 50 so that it is easily accessible and easily activated to test the emergency exit lighting. Section 7.9.3 of the NFPA's Life Safety Code typically requires a monthly activation test, where the lights remain illuminated for a minimum of 30-seconds, and an annual test where the lights are activated for 1.5-hours to simulate a long term emergency event. An alternative embodiment may have the on/off test button switch activated remotely through any of, or a combination of, wired control, wireless, Wi-Fi, RFID, cellular, and/or Bluetooth commands. A cellular application to activate an on/off test button switch 66 may be used. Such an application may save time and allow an interested party, such as a fire marshal, the ability to remotely test multiple emergency exit lighting fixtures at one time, and easily record the results of any such testing.

The integrated speaker 68 may be electronically coupled to an LED driver or a computerized control. The integrated speaker 68 may say such things as "Exit Here" or "Exit this way," in English or other languages. The sayings may be customized as necessary. The integrated speaker 68 may also be electronically coupled to a public address system.

The doorway emergency exit lighting fixture may be installed in new construction or retrofit to existing construction. The doorway emergency exit lighting fixture may be manufactured as one extrusion, or it may be manufactured in separate pieces and coupled together through fasteners, glue, welding, or other means.

Figure 7:
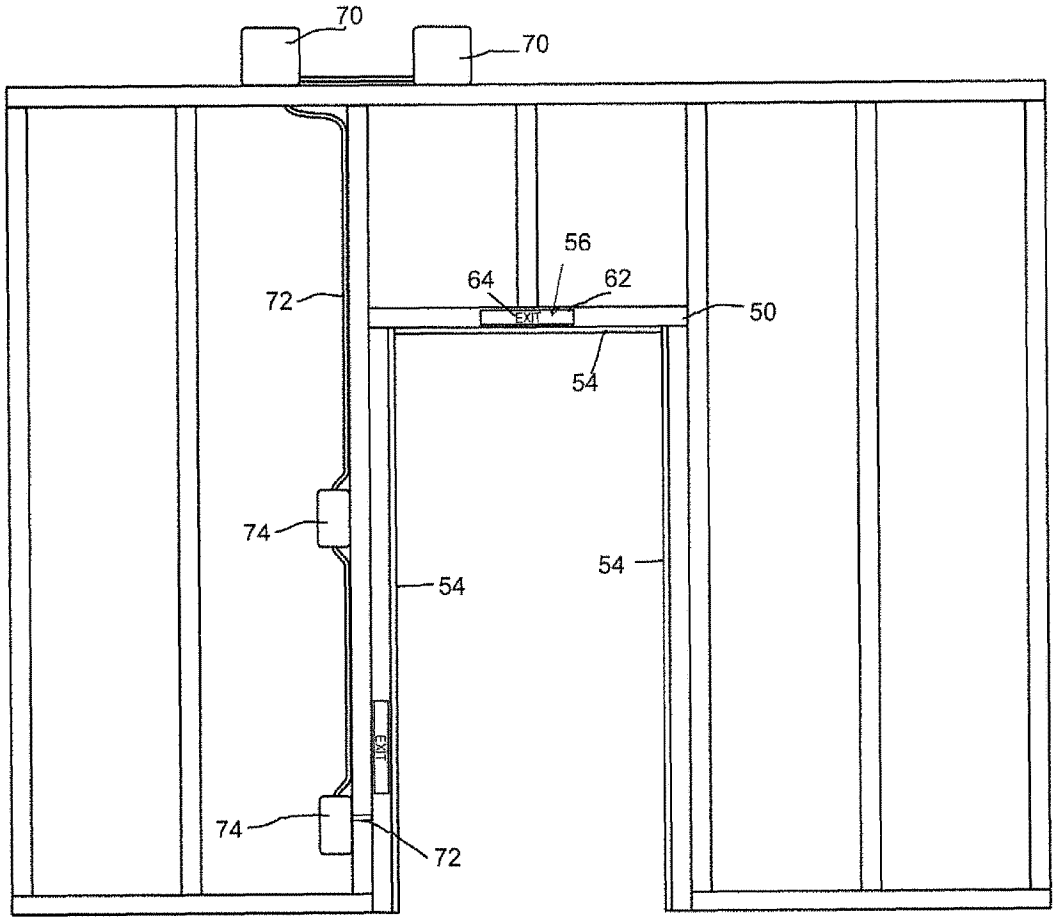
FIG. 7 depicts a front view of a possible embodiment of the present invention in an installed configuration.

Referring now to FIG. 7, a front view of the possible embodiment in FIG. 6 is shown installed in a doorway. A doorway emergency exit lighting fixture may comprise a casing 50, a jamb, and a stop 54. The casing 50, jamb, and stop 54 extend to the right (side casing, side jamb, and side stop), left (side casing, side jamb, and side stop), and top (top casing, top jamb, and top stop) of a doorway. The casing 50 should have at least one substantially rectangular cut-out 56 that is smaller than the casing front 52. There may be one or more cut-out(s) 56 on each of the top casing or side casings.

A translucent lens panel 62 substantially the same dimensions, or slightly larger than, the cut-out 56, may be mounted over the cut-out 56. At least one LED light electronically coupled to an LED driver should be placed behind the translucent lens panel 62 to provide emergency exit and sign illumination. The LED light(s) may be white, red, green, or a combination thereof.

The LED driver and/or a backup battery power source may be mounted in one or more junction boxes 70 or 74. A conduit 72 may connect the junction boxes 70 or 74 to the doorway emergency exit lighting fixture. The LED driver should be electronically coupled to at least one LED light(s) providing illumination.

The doorway emergency exit lighting fixture may be coupled to the building structure through fasteners, glue, welding, or other means.

Figure 8:
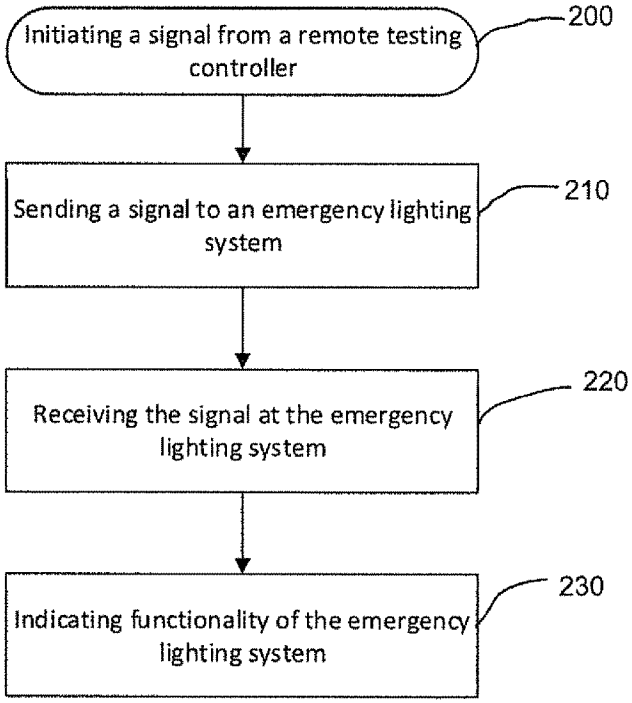
FIG. 8 depicts an example flowchart detailing a method of testing an emergency lighting system.

Referring now to FIG. 8, an exemplary flowchart detailing a possible method of testing an emergency lighting system in a building is shown. An embodiment of the method may be a user initiating 200 a signal from a remote testing controller, sending 210 the signal from the remote testing controller to an emergency lighting system, receiving 220 the signal at the emergency lighting system, and 230 indicating functionality.

A user may initiate 200 a signal from a remote testing controller which is a cellular telephone. A user may initiate 200 the signal through dialing a number, sending a text message, pressing a dedicated button, and/or pressing a button in a dedicated smartphone application. The remote testing controller may also be a keyfob with a dedicated button for testing an emergency lighting system.

The signal may be sent 210 through Wi-Fi, infrared, RFID, Bluetooth, and/or a cellular network. The signal may be received 220 by the emergency lighting system through an antenna electronically coupled to the emergency lighting system. The emergency lighting system may be an LED emergency lighting fixture located within a building.

Functionality of the emergency lighting system (that is, whether the emergency lighting system works properly or not) may be indicated 230 on the remote testing controller, on a centralized control panel, and/or on the emergency lighting system itself. The functionality, or lack thereof, may be recorded by any means. Per safety codes, emergency lighting systems should be tested once a month and every year. The method described herein may be an economical and fast method of performing these required tests.

Figure 9:
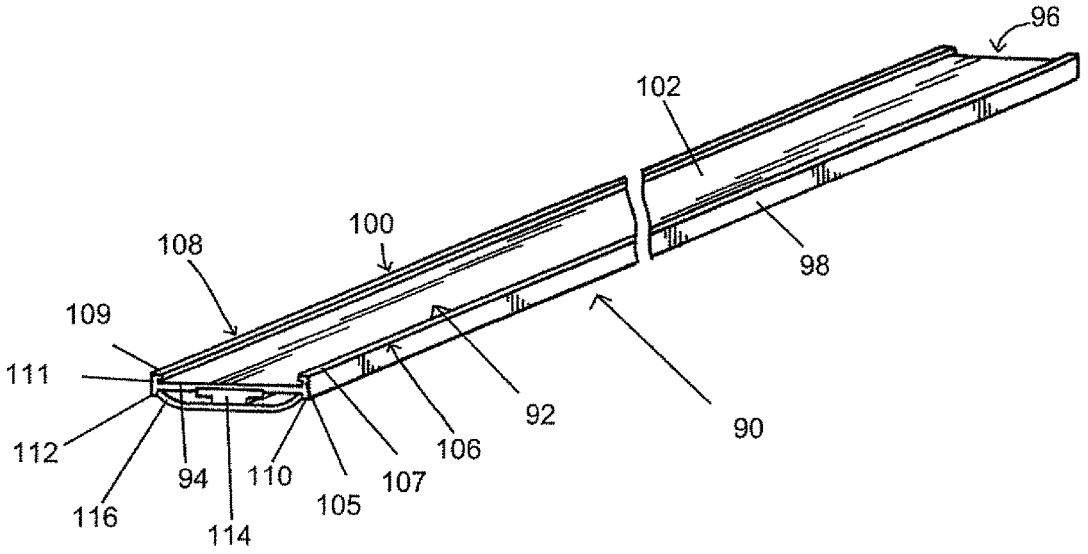
FIG. 9 depicts an isometric view of a possible embodiment of the present invention that may be used in a ceiling.

An embodiment of the invention is shown in FIG. 9. A snap-on emergency exit lighting fixture 90 may comprise the following: an elongate semi-rigid flat base 92 extending between a first end 94 and a second end 96, having a substantially rectangular shape, a right edge 98, a left edge 100, a top plane 102, and a bottom plane (not shown). The fixture 90 further comprises at least one right top catch 106 extending along a portion of the right edge 98. Catch 106 preferably includes two planar members, a first vertical planar member 105 substantially perpendicular to the top plane 102. Catch first vertical planar member preferably sets the widest edge of the fixture. Catch 106 may also employ a second horizontal planar member 107 generally parallel to top plane 102. Catch second horizontal member 107 is provided to maintain the position of the fixture along the T-grid both against gravity, as well as to provide three-sided coupling with the T-grid via a) flat base 92, b) catch vertical member 105, and c) catch horizontal member 107 along the top. Catches (e.g. top right, top left, bottom right, and bottom left), as described herein, refer to similar structure including vertical and horizontal members to cover the side edge and bottom of a T-grid or a translucent lens panel 116. Preferably, the vertical and horizontal members of the catches meet one another at a ninety degree angle, or are otherwise arranged to match the contours of a T-grid or translucent lens panel 116.

The fixture 90 further comprises at least one left top catch 108 extending along a portion of the left edge 100. Catch 108 preferably includes two planar members, a first vertical planar member 111 substantially perpendicular to the top plane 102. Catch 108 may also employ a second horizontal planar member 109 generally parallel to top plane 102. The fixture 90 further comprises at least one right bottom catch 110 extending along a portion of the right edge 98 and substantially perpendicular to the bottom plane (not shown), and at least one left bottom catch 112 extending along a portion of the left edge 100 and substantially perpendicular to the bottom plane (not shown). An LED light 114 may be coupled to the bottom plane (not shown). A translucent lens panel 116 adapted to diffuse light from an LED light 114 should be mounted to the at least one right bottom catch 110 and at least one left bottom catch 112.

The various top, bottom, right, and left catches 106, 108, 110, and 112, may or may not substantially extend the length of the fixture 90. If any one of the top, bottom, right, and left catches 106, 108, 110, and 112 do not substantially extend for the length of the fixture 90, multiple top, bottom, right, and/or left catches 106, 108, 110, and 112 may be present. It may be easier to install and manufacture a fixture 90 where the top, bottom, right, and left catches 106, 108, 110, and 112 substantially extend for the length of the fixture 90. However, multiple top, bottom, right, and left catches 106, 108, 110, and 112 may be lighter and cheaper to manufacture.

The various vertical members of the top, bottom, right, and left catches 106, 108, 110, and 112, may or may not be substantially perpendicular to the top plane 102 or the bottom plane 104. Different angles may be used depending on the flexibility of the flat base 92, the thickness of the T-grid, or other factors. Any angle that is used should facilitate the attachment of the fixture 90 to a T-grid.

The embodiment shown in FIG. 9 is designed to snap onto a T-Grid (also known as a T-bar), as is known in the art for standard structure in drop ceilings, through the at least one right top catch 106 and at least one left top catch 108. The fixture 90 may also slide onto a T-Grid instead of snapping onto one. Flanges on standard T-Grids may support acoustic tiles, air conditioning vents, and the like. The snap-on emergency exit lighting fixture 90 may also support acoustic tiles. T-Grids, and this embodiment of the present invention, typically come in two-foot or four-foot segments. The fixture 90 and top plane 102 is designed to be slightly wider than a standard T-Grid so that it can be attached to an already installed T-grid with ease.

The flat base 92 is semi-rigid to allow the at least one top right and left catches 106 and 108 to snap onto a T-Grid. Some flexibility is required in the flat base 92 to allow this installation method. However, the flat base 92 cannot be entirely flexible or it may not stay attached to a T-Grid for any appreciable length of time or be able to support the actual emergency exit light 114.

The translucent lens panel 116 may be substantially the same size and length as the flat base 92, or it may be smaller.

The flat base 92 and various top, bottom, right, and left catches 106, 108, 110, and 112 may be formed from a variety and combination of materials, such as metals, plastics, and/or wood. The flat base 92 and various top, bottom, right, and left catches 106, 108, 110, and 112 may be formed together as one extrusion, or they may be formed as separate pieces and coupled together through fasteners, glue, welding, and/or any other way.

The flat base 92 and various top, bottom, right, and left catches 106, 108, 110, and 112 may be adapted to couple with existing T-Grids or a different ceiling assembly. They may couple through the use of fasteners, glue, welding, and/or magnets. It is intended that the emergency exit lighting fixture be relatively easy to manufacture and install.

One or more antennae may be mounted to the snap-on emergency exit lighting fixture 90 in order to receive wireless, Wi-Fi. RFID, and/or Bluetooth signals.

There may be an end-cap cover on either or both of the first end 94 and second end 96. This end-cap cover may protect the LED light(s) 114 and the fixture 90 in general from moisture, dust, dirt, or other contaminants. The end-cap cover(s) may be attached through the use of fasteners, glue, welding, and/or magnets. The end-cap cover(s) may be attached during the manufacture of the fixture 90 or afterwards. The end-cap cover(s) may be attached during the installation of the fixture 90 or afterwards.

Figure 10:
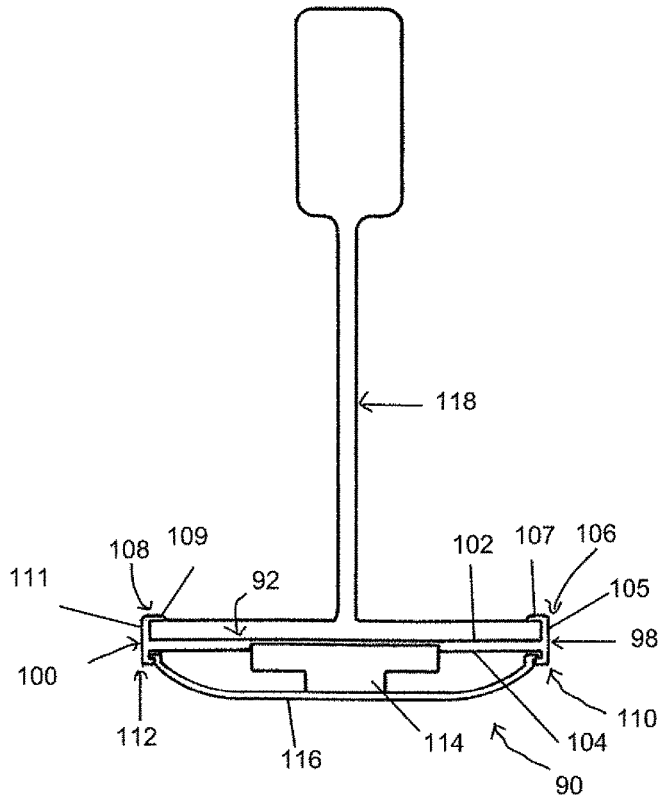
FIG. 10 depicts a frontal view of a possible embodiment of the present invention that may be used in a ceiling.

Referring now to FIG. 10, a frontal view of the possible embodiment in FIG. 9 of the present invention is shown attached to a T-Grid 118. A snap-on emergency exit lighting fixture 90 may comprise the following: an elongate semi-rigid flat base 92 extending between a first end 94 and a second end 96, having a substantially rectangular shape, a right edge 98, a left edge 100, a top plane 102, and a bottom plane 104. The fixture 90 further comprises at least one right top catch 106 extending along a portion of the right edge 98 with a substantially vertical member 105 and a substantially horizontal member 107. The fixture 90 further comprises at least one left top catch 108 extending along a portion of the left edge 100 with a substantially vertical member 111 and a and substantially horizontal member 109. The fixture 90 further comprises at least one right bottom catch 110 extending along a portion of the right edge 98 with substantially vertical and horizontal members, and at least one left bottom catch 112 extending along a portion of the left edge 100 with substantially vertical and horizontal members. An LED light 114 may be coupled to the bottom plane 104. A translucent lens panel 116 adapted to diffuse light from an LED light 114 should be mounted to the at least one right bottom catch 110 and at least one left bottom catch 112. An on/off test button switch may be placed on the translucent lens panel 116 or elsewhere on the fixture 90.

The translucent lens panel 116 may be clear, frosty, red, and/or green. The translucent lens panel 116 may also have at least one area cut out in the shape of the word EXIT. A red or green translucent lens panel may be placed within the cut out portion. The translucent lens panel 116 may also have at least one area cut out in the shape of an arrow, to indicate emergency exit direction. A red or green translucent lens panel may be placed within the cut out portion. The translucent lens panel 116 may be easily removable in order to repair and maintain the fixture, and to allow the at least one LED light 114 to be replaced if necessary. The translucent lens panel 116 may be glass and/or plastic.

At least one LED light 114 may be mounted to the bottom plane 104 of the flat base 92 through glue, fasteners, welding, or any other means. The LED light(s) 114 may be red, green, yellow or white in color (i.e. they may produce light with a red, green, yellow, or white tint). The LED light(s) 114 should produce enough light to satisfy applicable emergency lighting codes and regulations. In its Life Safety Code, section 7.9, the National Fire Protection Agency (NFPA) states that emergency lighting must be arranged to provide initial illumination of not less than an average of one foot-candle and a minimum at any point of 0.1-foot-candle measured along the path of egress at floor level. These levels can decline to a minimum of 0.6-foot-candle average and 0.06-foot-candle at any one point at the end of 1.5-hours. One foot-candle is equivalent to 10.764 lumens per square meter or one lumen per square foot.

The LED light(s) 114 may be mounted to the bottom plane 104 of the flat base 92 and within a recessed channel. The recessed channel may be useful in directing the light produced by the LED light(s) 114 downward and preventing light diffusion to the sides or upward. The recessed channel may also ease manufacture and installation of the emergency exit lighting fixture.

An on/off test button switch may be located along the translucent lens panel 116 so that the switch is easily accessible and easily activated to test the emergency exit lighting. Section 7.93 of the NFPA's Life Safety Code typically requires a monthly activation test, where the lights remain illuminated for a minimum of 30-seconds, and an annual test where the lights are activated for 1.5-hours to simulate a long-term emergency event. An alternative embodiment may have the on/off test button switch activated remotely through any of, or a combination of, wired control, wireless, Wi-Fi, RFID (radio frequency identification signal), cellular, and/or Bluetooth commands. A cellular application to activate an on/off test button switch may be used. Such an application may save time and allow an interested party, such as a fire marshal, the ability to remotely test multiple emergency exit lighting fixtures at one time, and easily record the results of any such testing.

Figure 11:
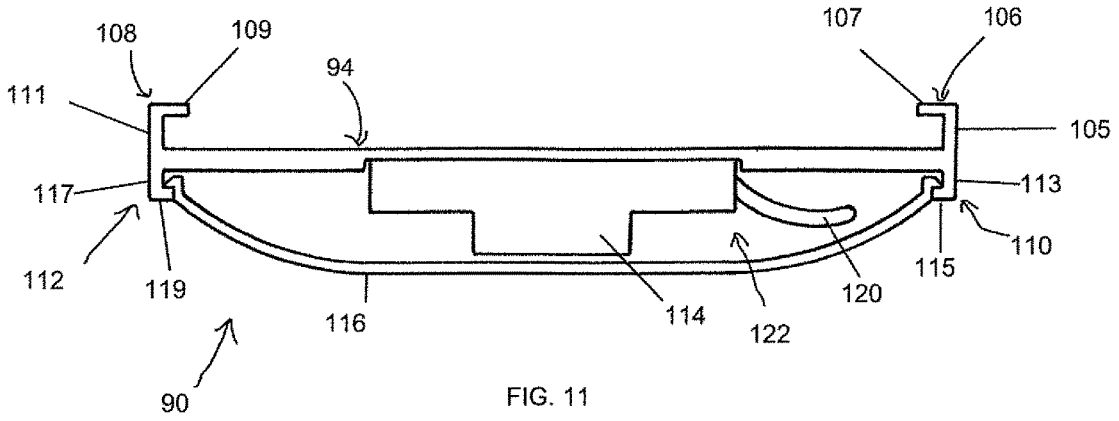
FIG. 11 depicts a frontal view of a possible embodiment of the present invention that may be used in a ceiling.

Referring now to FIG. 11, a frontal view of the possible embodiment in FIG. 9 of the present invention is shown with the addition of a electrical conduit or whip 120. The fixture 90 further comprises at least one right top catch 106 extending along a portion of the right edge 98 with a substantially vertical member 105 and a substantially horizontal member 107. The fixture 90 further comprises at least one left top catch 108 extending along a portion of the left edge 100 with a substantially vertical member 111 and a and substantially horizontal member 109. The fixture 90 further comprises at least one right bottom catch 110 extending along a portion of the right edge 98 with substantially vertical member 113 and substantially horizontal member 115, and at least one left bottom catch 112 extending along a portion of the left edge 100 with substantially vertical member 117 and substantially horizontal member 119. The LED light(s) 114 should be electronically coupled (i.e. wired) to an LED driver. The LED light(s) 114 may be electronically coupled through a conduit or whip 120 that may snake through the empty area 122 between the LED light(s) 114 and the translucent lens panel 116. The conduit or whip 120 may proceed out of the fixture 90 through either the first end 94 or the second end (not shown). An LED driver should be electronically coupled to a first, continuous power source, a backup battery containing enough power to power the LED light(s) 114 for at least 1.5-hours, and an on/off test button switch. The LED driver will control the functions of the LED light(s) 114 and may be modified as necessary. The LED driver may be located at some distance from the LED light(s), for example, in a typical junction box, and may be electronically coupled to the LED light(s) through a conduit or whip 120. The LED driver may also be electronically coupled to one or more antennae in order to receive wireless, RFID, and/or Bluetooth signals.

Figure 12:
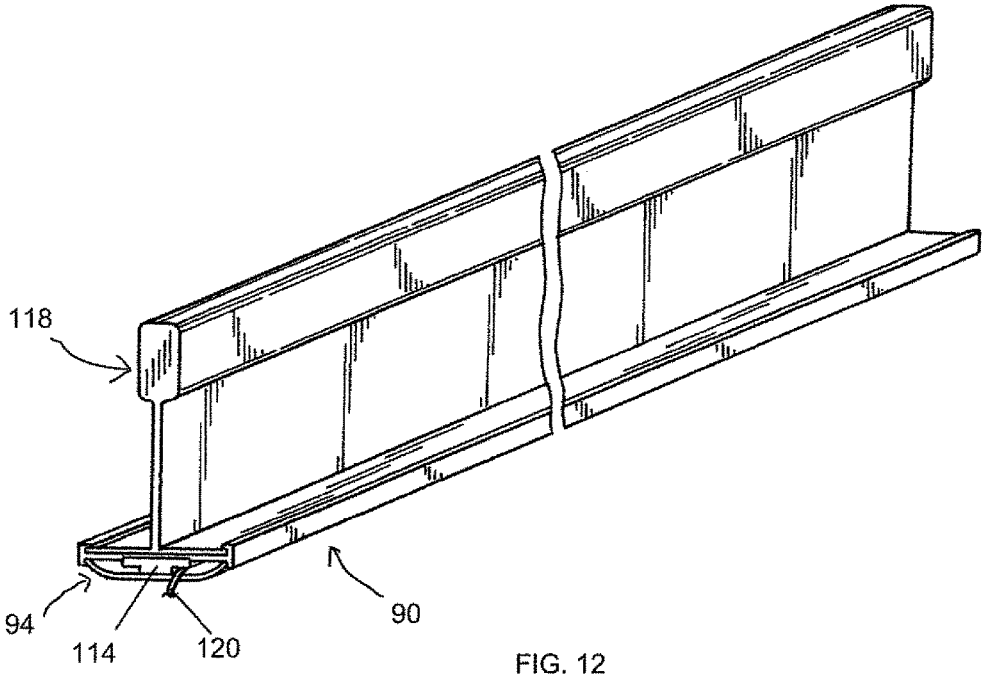
FIG. 12 depicts a partial isometric view of a possible embodiment of the present invention that may be used in a ceiling.

Referring now to FIG. 12, an isometric view of the possible embodiment in FIG. 9 of the present invention is shown with the addition of a electrical conduit or whip 120 and attached to a T-grid 118. The electrical conduit or whip 120 may protrude out of the fixture 90 through the first end 94 and/or the second end. Once the conduit or whip 120 is outside the confines of the fixture 90, it may be electronically coupled to an LED driver and/or power supply, in order for the fixture 90 to function properly as an emergency exit light.

Figure 13:
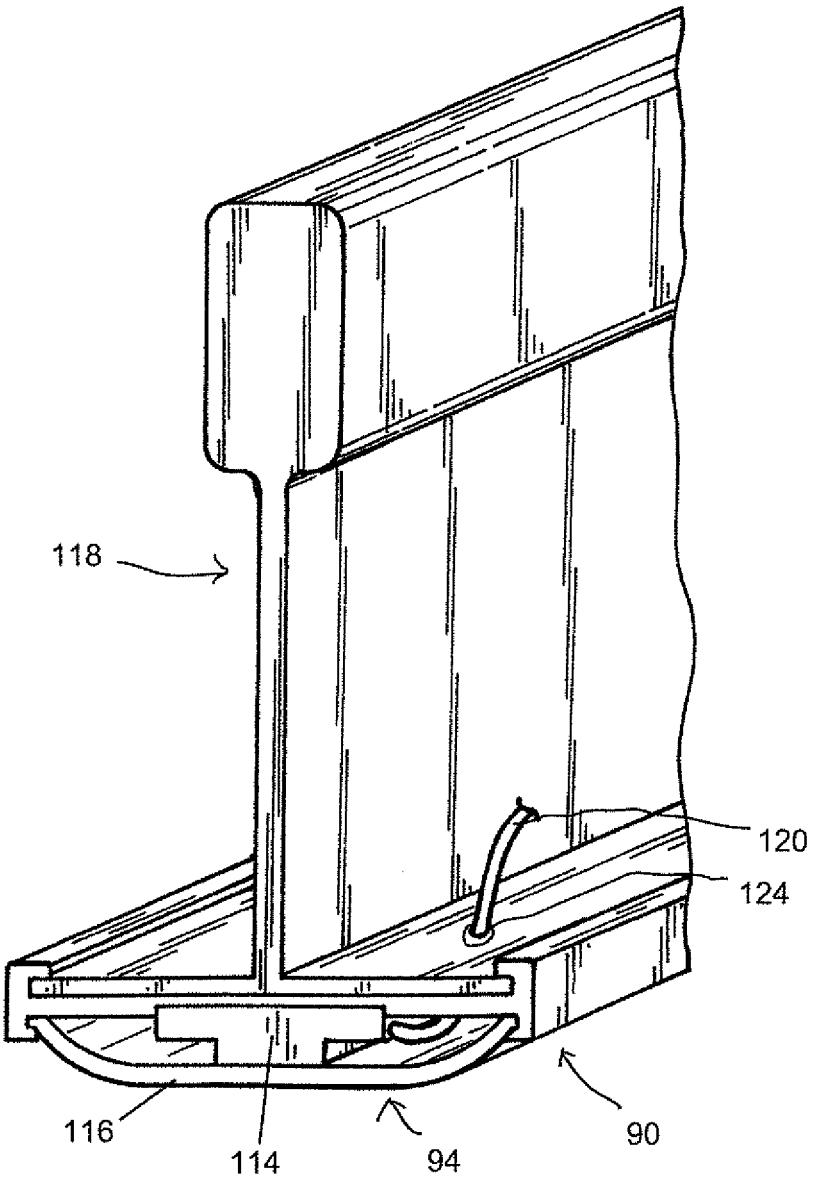
FIG. 13 depicts a partial isometric view of an end of a possible embodiment of the present invention that may be used in a ceiling.

Referring now to FIG. 13, a partial isometric view of the possible embodiment in FIG. 9 of the present invention is shown with the addition of a electrical conduit or whip 120 and attached to a T-grid 118. A wire-path aperture 124 may be drilled in a T-grid so the electrical conduit or whip 120 may be placed through the aperture 124 instead of protruding out of the fixture 90 as in FIG. 12. The wire-path aperture 124 may be drilled or it may already exist on the T-grid. Guiding the electrical conduit or whip 120 through at least one aperture 124 in a T-grid may provide for easier installation and may be more aesthetically pleasing. In addition, this configuration may be safer in that there would be no exposed wires.

Figure 14:
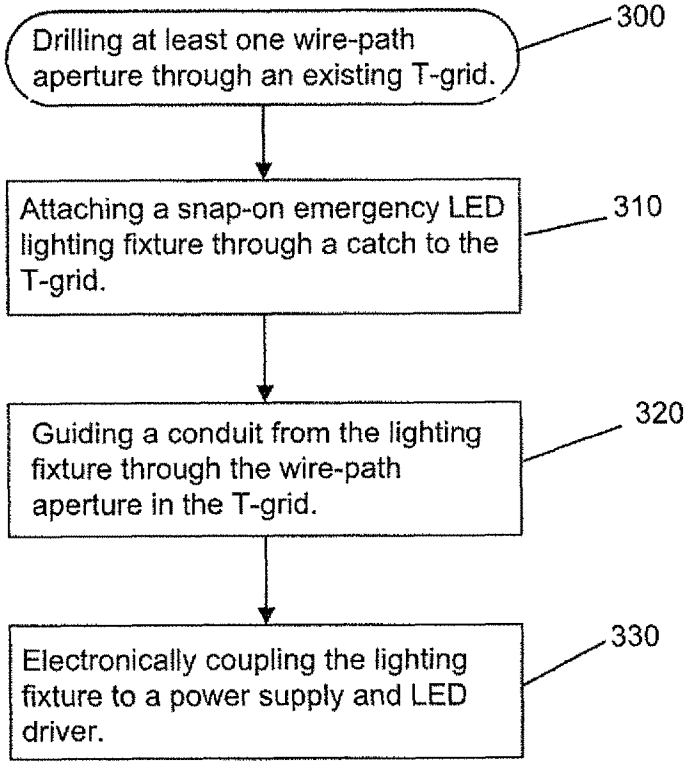
FIG. 14 depicts an example flowchart detailing a method of installing a possible embodiment of the invention.

Referring now to FIG. 14, an exemplary flowchart detailing a possible method of installing a snap-on emergency lighting system in a building is shown. An embodiment of the method may be a user drilling 300 at least one wire-path aperture through an existing T-grid in a ceiling, attaching 310 a snap-on emergency lighting fixture (with LEDs or other lights) through at least one catch to the T-grid, guiding 320 at least one conduit or whip through the at least one wire-path aperture, and 330 electronically coupling the lighting fixture to a power supply and LED driver (if an LED light is used).

Drilling 300 at least one wire-path through an existing T-grid before attaching a snap-on emergency lighting fixture may be economical and easier than other methods. Utilizing an existing hole instead of drilling a new wire-path may be feasible in some instances and may further simplify the installation of the present invention.

A user may attach 310 a snap-on emergency LED lighting fixture by bending the fixture so that one or more catches on the fixture can hook onto an existing T-grid. Alternatively, a user may attach 310 the lighting fixture by removing the T-grid from the ceiling and then sliding the fixture onto the T-grid, coupling the appropriate wires, and then replacing the T-grid into the ceiling.

The invention claimed is:

1. A snap-on emergency exit lighting fixture comprising:

an elongate semi-rigid flat base extending between a first end and a second end, said flat base comprising a right edge, a left edge, a top plane, and a bottom plane;

at least one right top catch extending along a portion of said right edge;

at least one left top catch extending along a portion of said left edge;

at least one right bottom catch extending along a portion of said right edge;

at least one left bottom catch extending along a portion of said left edge;

at least one LED light mounted to said bottom plane;

an LED driver electronically coupled to a first power source, a backup battery containing enough power to power said at least one LED light for at least 90 minutes, said at least one LED light, and an on/off test switch; and a translucent lens panel mounted at least partially below said bottom plane via said at least one right bottom catch and said at least one left bottom catch, said translucent lens adapted to diffuse light from said LED light.

2. The snap-on emergency exit lighting fixture of claim 1, wherein said translucent lens comprises at least one cut-out, with a red or green color translucent lens panel placed within said at least one colored cut-out.

3. The snap-on emergency exit lighting fixture of claim 1, wherein said at least one LED light further comprises colored LEDs in either red or green color.

4. The snap-on emergency exit lighting fixture of claim 1, further comprising a wireless antenna electronically coupled to said on/off test switch and said LED driver.

5. The snap-on emergency exit lighting fixture of claim 4, wherein said wireless antenna is adapted to receive a signal from a Wi-Fi connected smartphone application so as to activate the on/off test switch.

6. The snap-on emergency exit lighting fixture of claim 1 further comprising a T-grid coupled with said at least one left top catch and said at least one right top catch.

* * * * *